US005413039A

United States Patent [19]

Sohma

[11] Patent Number: 5,413,039

[45] Date of Patent: May 9, 1995

[54] ROTARY PRESS AND FEEDER UNIT FOR THE SAME

[75] Inventor: Isao Sohma, Yokohama, Japan

[73] Assignee: Tokyo Kikai Seisakusho, Ltd., Tokyo, Japan

[21] Appl. No.: 285,629

[22] Filed: Aug. 4, 1994

Related U.S. Application Data

[63] Continuation of Ser. No. 54,252, Apr. 30, 1993, abandoned.

[30] Foreign Application Priority Data

Jul. 22, 1992 [JP] Japan ..... 4-215744

[51] Int. Cl.[6] ..... B41F 13/56

[52] U.S. Cl. ..... 101/225; 101/226; 101/219; 226/197; 226/199

[58] Field of Search ..... 101/216, 219, 222, 223, 101/224, 225, 226, 227, 228, 230, 231; 226/197, 199; 270/21.1, 52.5

[56] References Cited

U.S. PATENT DOCUMENTS

| | | | |
|---|---|---|---|
| 1,900,535 | 3/1933 | Wood | 101/225 |
| 1,977,771 | 8/1934 | Crafts | 101/225 |
| 2,126,877 | 8/1938 | Foster | 101/220 |
| 3,623,645 | 11/1971 | Klingler | 226/199 |
| 4,111,122 | 9/1978 | Kutzner et al. | 101/228 |
| 4,393,772 | 7/1983 | Burger | 101/225 |
| 4,538,517 | 9/1985 | Michalik et al. | 101/227 |
| 4,610,198 | 9/1986 | Raymond | 101/223 |
| 4,667,946 | 3/1987 | Taguchi et al. | 270/525 |
| 4,725,050 | 2/1988 | Fujishiro | 226/199 |
| 4,799,660 | 1/1989 | Pfizenmaier | 270/21.1 |
| 4,930,415 | 6/1990 | Hara et al. | 101/228 |
| 5,016,801 | 5/1991 | Gilat et al. | 226/197 |
| 5,121,910 | 6/1992 | Hajek et al. | 226/197 |
| 5,199,351 | 4/1993 | Shibuya et al. | 226/197 |

FOREIGN PATENT DOCUMENTS

| | | | |
|---|---|---|---|
| 0318852 | 6/1989 | European Pat. Off. | 101/228 |

OTHER PUBLICATIONS

Handbook of Printing Engineering, 1st edition, 2nd impression, (Jul. 20, 1983, published by the Gihodo Publishing Co., Ltd.).

Ifra Newspaper Techniques, English edition, (Apr. 1988, published by the INCA-FIEJ Research Association) pp. 64–73.

*Primary Examiner*—Eugene H. Eickholt

*Attorney, Agent, or Firm*—Armstrong, Westerman, Hattori, McLeland & Naughton

[57] ABSTRACT

A rotary press has a feeder unit provided with a paper roll support frame, and a printing unit (tower type printing unit) provided with a printing means, and the feeder unit is disposed in a non-parallel and vertical relation with respect to the printing unit, the rotary press being further provided with a means for turning a paper web, which is fed from a paper roll supported on the feeder unit, and sent to the printing means, in such a manner that the surface of the paper web is opposed to the printing means. The web turning means is provided so that the guide surface thereof can be displaced in the direction in which the position of a paper web is changed with respect to the widthwise direction of the printing means. The feeder unit is provided with a plurality of paper roll support frames so that the paper webs can be drawn out at once from at least two paper rolls out of the paper rolls set on these paper roll support frames.

9 Claims, 6 Drawing Sheets

ROTARY PRESS AND FEEDER UNIT FOR THE SAME

This application is a continuation of application Ser. No. 08/054,252, filed Apr. 30, 1993, now abandoned.

BACKGROUND OF THE INVENTION

1. Field of the Invention

This invention relates to a rotary press in which a feeder unit and a printing unit are vertically arranged, and a feeder unit for such a rotary press.

2. Description of the Prior Art

A prior art rotary press in which a feeder unit and a printing unit are vertically arranged has construction shown in, for example, "Handbook of Printing Engineering", first edition, second impression (Jul. 20, 1983, published by the Gihodo Publishing Co., Ltd.), page 887, FIGS. 5 and 11, page 889, FIGS. 5 and 13, and it is known well in, especially, the newspaper publishing field.

In this rotary press, a feeder unit 51 and a printing unit 52 are arranged in parallel with each other, i.e., the axes of the paper rolls 55 provided in the feeder unit 51 and those of the printing cylinders 54 constituting a printing means 53 in the printing unit 52 extend in parallel with one another as shown in FIG. 10, and a paper web 56 drawn out from a paper roll 55 is guided by a guide surface of a web guide 57, the axis of which extend in parallel with those of the printing cylinders 54, in such a manner that the paper web 56 reaches the printing means 53.

In order to supply a paper roll 55 to a feeder unit 51, every other space between two adjacent feeder units 51, 51 is widened enough to admit a paper roll thereinto, and a paper roll 55 introduced into this widely secured region is supplied selectively to one of two feeder units 51, 51 disposed on both sides of this region. A regular operation for handling the paper roll 55 is also carried out in the same region.

In a feeder unit 51, a rotary shaft 59 is provided on two columnar frames 58, 58, and paper rolls 55 are held between arms 60, 60 provided on this rotary shaft 59 as shown in FIG. 11. The distance between these two columnar frames 58, 58 is set longer than that between frames 61, 61 of the printing unit 52 by a distance required by additionally provided arms 60, 60. Another reason for setting the distance between these frames 58, 58 longer than that of the frames 61, 61 of the printing unit 52 resides in the necessity of providing a means 62 for turning the arms 60 via the rotary shaft 59, and a means 63 for moving the arms 60, 60 via the rotary shaft 59 in the axial direction thereof while keeping the distance between the arms 60, 60 unchanged, so as to adjust a widthwise deviation of the paper rolls 55 held between the arms 60 and that of the paper webs 56 drawn out therefrom with respect to the printing cylinder 54.

In recent years, a tower type printing unit, in which a plurality of printing means 53 are stacked up, shown in, for example, "Ifra Newspaper Techniques", English edition, April 1988 (published by the INCA-FIEJ Research Association), pages 64–73, has been provided.

In this tower type printing unit 64, the printing can be done on at least one surface of a single paper web 56 with a plurality of colors of ink by a plurality of printing means 53 as shown in, for example, FIGS. 8 and 9. It is known that passing a plurality of paper webs 56, 56, for example, two paper webs 56, 56 through different printing means 53 in the tower type printing unit 64 and printing images on at least one surface of each of the paper webs 56, 56 with not less than one color of ink as shown in FIG. 8 are possible. It is known that this enables the number of color printed pages of, for example, newspaper to be increased, and the variation of color printing techniques and the variation of arrangement of color printed pages to be increased.

A path along which the paper webs 56 in FIG. 8 reaches a folder unit 65 via the printing units 52 is substantially identical with that shown in FIG. 10, and an illustration thereof is omitted.

These prior art rotary presses have the following problems to be solved. (1) Since a regular operation for handling paper rolls in the feeder units including an operation for supplying paper rolls to the feeder units is carried out between the feeder units, it is necessary that the distance between the positions of installation of the feeder units be suitably secured. Consequently, a arrangement of feeder units becomes longer than that of printing units, so that the arrangement of feeder units cannot be included within the space just below that of printing units.

(2) In order to printing images on a plurality of paper webs by a tower type printing unit, a plurality of feeder units per printing unit are required. Consequently, a arrangement of feeder units becomes far longer than that of printing units, and useless spaces occur in the arrangement of printing units and above the same arrangement in terms of installation of the rotary press.

(3) In order to adjust a widthwise deviation of a paper web drawn out from a paper roll held in a feeder unit, with respect to the relative printing means, it is necessary that the arms on which the paper roll is held be moved with a rotary shaft which supports the arms. This causes the dimensions of the feeder unit to increase, and a large driving force to be required.

Accordingly, a space-saving rotary press in which a arrangement of feeder units does not become longer than that of printing units has been demanded. Regarding, especially, a rotary press provided with tower type printing units, a space-saving rotary press capable of supplying a plurality of paper webs to the tower type printing units has been demanded. In connection with the matter, devising a space-saving method for the feeder units in a rotary press has been demanded.

SUMMARY OF THE INVENTION

An object of the present invention is to provide a rotary press which meets the demands of the prior art rotary presses by solving these problems at once, and a feeder unit for such a rotary press.

The rotary press according to the present invention has feeder units provided with paper roll support frames, and printing units provided with printing means, and the feeder units are disposed in a non-parallel and vertical relation with respect to the printing units, the rotary press being further provided with a means for turning a paper web, which is fed from a paper roll supported on a feeder unit, and sent to a printing means, in such a manner that the surface of the paper web is opposed to the printing means. The web turning means is provided so that the guide surface thereof can be moved in the direction in which the position of a paper web is changed with respect to the widthwise direction of the printing means.

Each feeder unit may be provided with a plurality of paper roll support frames so that paper webs can be drawn out at once from at least two paper rolls out of the paper rolls set on these paper roll support frames.

Each printing unit may be a regular printing unit or a tower type printing unit in which a plurality of printing means are stacked.

Since a feeder unit is provided in a non-parallel relation with respect to the corresponding printing unit, a regular paper web handling operation including the supplying of paper rolls to a feeder unit can be carried out from one side of the feeder unit, i.e., it becomes unnecessary to carry out such an operation in a space between feeder units. Accordingly, the installation intervals of the feeder units can be reduced, so that the length of a arrangement of feeder units decreases. This enables all of the feeder units to be arranged within a space just below the printing units.

Since a plurality of paper rolls are set on each feeder unit provided in a non-parallel relation with respect to the relative printing unit, in such a manner that paper webs are drawn out at once from at least two paper rolls out of these paper rolls, the number of the feeder units in a rotary press can be decreased, and the feeder units can be arranged in a much wider space, so that the space for installing a rotary press is saved.

In the case where a feeder unit capable of paying out paper webs from at least two paper rolls is provided in a rotary press with tower type printing unit, the printing of images is done on each of a plurality of paper webs. Consequently, the number of the feeder units decreases, and the sizes in plan of a space in which the feeder units are arranged become not larger than those of the space in which the printing units are arranged.

In any of these cases, the feeder units are not parallel to the printing units, so that the surface of a paper web fed from a paper roll supported on a feeder unit is not opposed to the relative printing means. However, the surface of such a paper web can be turned so as to be opposed to the relative printing means by using, for example, a web turning means having a guide surface inclined in the paper web guiding direction.

The web turning means is also formed so that the guide surface thereof is moved, for example, in the direction parallel to the longitudinal direction of a paper web advancing toward the guide surface, or in the direction parallel to the longitudinal direction of a paper web leaving the guide surface. Therefore, the travelling position of a paper web leaving the guide surface is shifted in the widthwise direction, so that the position of the paper web with respect to the widthwise direction of the printing means is changed.

The above and other objects, features and advantages of the present invention will become apparent from reading of the following description which has been made in connection with the accompanying drawings.

BRIEF DESCRIPTION OF THE DRAWINGS

The present invention is illustrated in the following drawings in which.

DESCRIPTION OF THE PREFERRED EMBODIMENTS

A rotary press and a feeder unit embodying the present invention will now be described with reference to the drawings.

Figure 1:
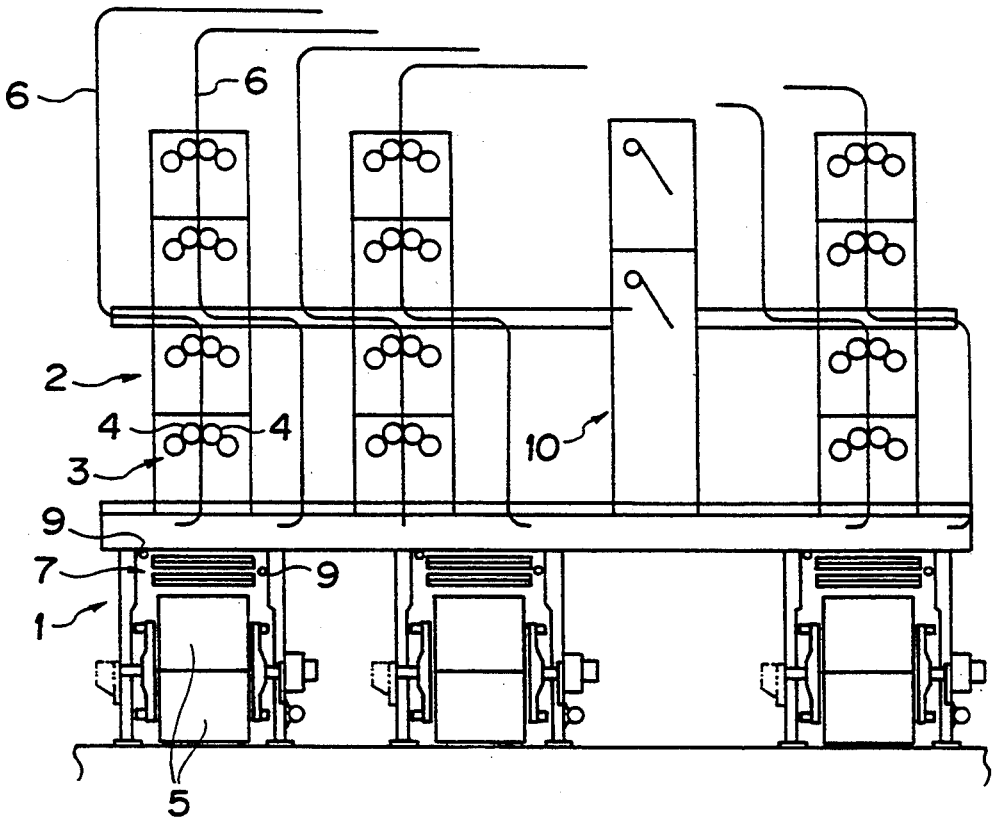
FIG. 1 is a schematic front elevation of a first embodiment of the rotary press according to the present invention.
Figure 2:
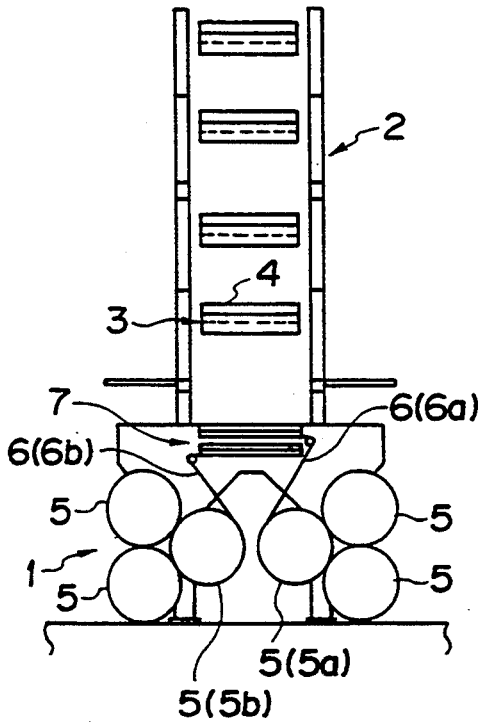
FIG. 2 is a schematic side elevation of the first embodiment of the rotary press according to the present invention.

In the first embodiment of the rotary press shown in FIGS. 1 and 2, a feeder unit 1 and a tower type printing unit 2 are arranged vertically so that the feeder unit 1 extend at right angles to the tower type printing unit 2, i.e., the axes of paper rolls 5 supported on the feeder unit 1 extend at right angles to those of printing cylinders 4 in a printing means 3 in the tower type printing unit 2. The feeder unit 1 is capable of supporting thereon a plurality of paper rolls 5 (six paper rolls in the illustrated embodiment), and feeding paper webs 6 can be drawn out from a plurality of paper rolls 5 (two paper rolls in the illustrated embodiment) out of the paper rolls 5 held on the feeder unit 1.

In a paper web threading path along which a paper web 6 drawn out from a paper roll 5 advances up to a printing means 3 in the tower type printing unit 2, a means 7 for turning the surface of a paper web 6 so as to be opposed to the circumferential surfaces of the printing cylinders 4 in the printing means 3 is provided.

According to this structure, the paper webs **6*a*, 6*b* drawn out from two paper rolls 5*a*, 5*b* out of the paper rolls 5 supported on the feeder unit 1 are turned by the respective web turning means 7 and guided toward the tower type printing unit 2**.

Figure 3:
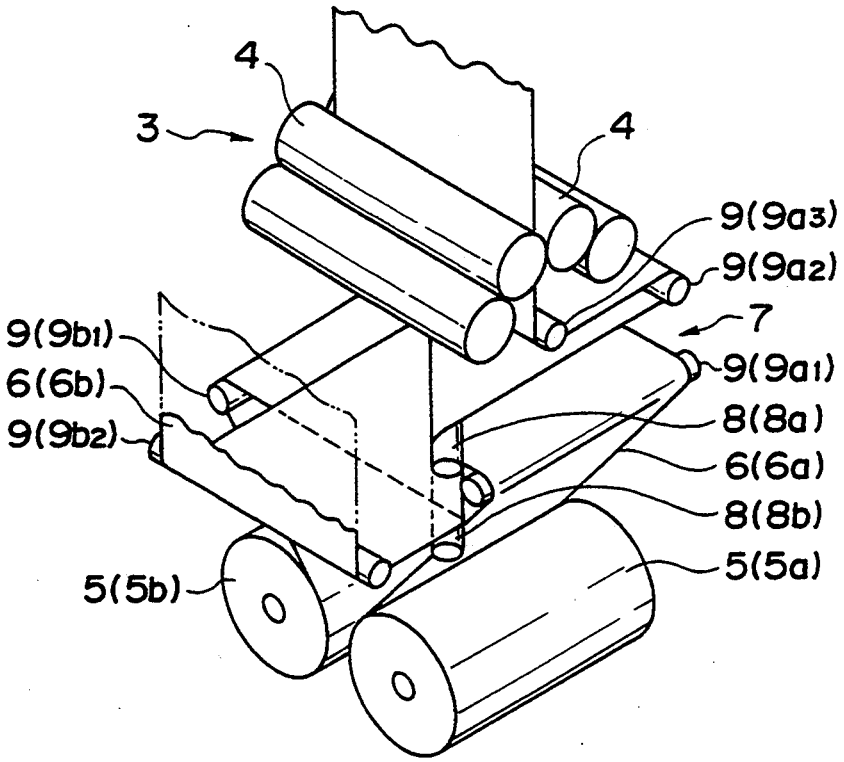
FIG. 3 is a schematic perspective view showing the condition of a paper web passed from a feeder unit on which paper rolls are supported to a printing means in the first embodiment of the rotary press according to the present invention

Each web turning means 7 consists of a turning bar 8 as shown in, for example, FIG. 3, and is adapted to guide a paper web 6 to the printing means 3 by the auxiliary actions of some guide rollers 9. Referring to FIG. 3, a paper web **6*a* drawn out from a paper roll 5*a* is guided to a printing means 3 via a guide roller 9*a*1, a turning bar 8*a*, a guide roller 9*a*2 and a guide roller 9*a*3, while a paper web 6*b* drawn out from a paper roll 5*b* passes a guide roller 9*b*1, a turning bar 8*b* and a guide roller 9*b*2, advances so as to shunt the printing means 3**, and is guided to another printing means (not shown).

Referring to FIG. 1, the paper webs 6 which have passed two printing means 3 are printed on their both surfaces with images by using two kinds of ink, guided to a folder unit 10 and folded therein.

Figure 8:
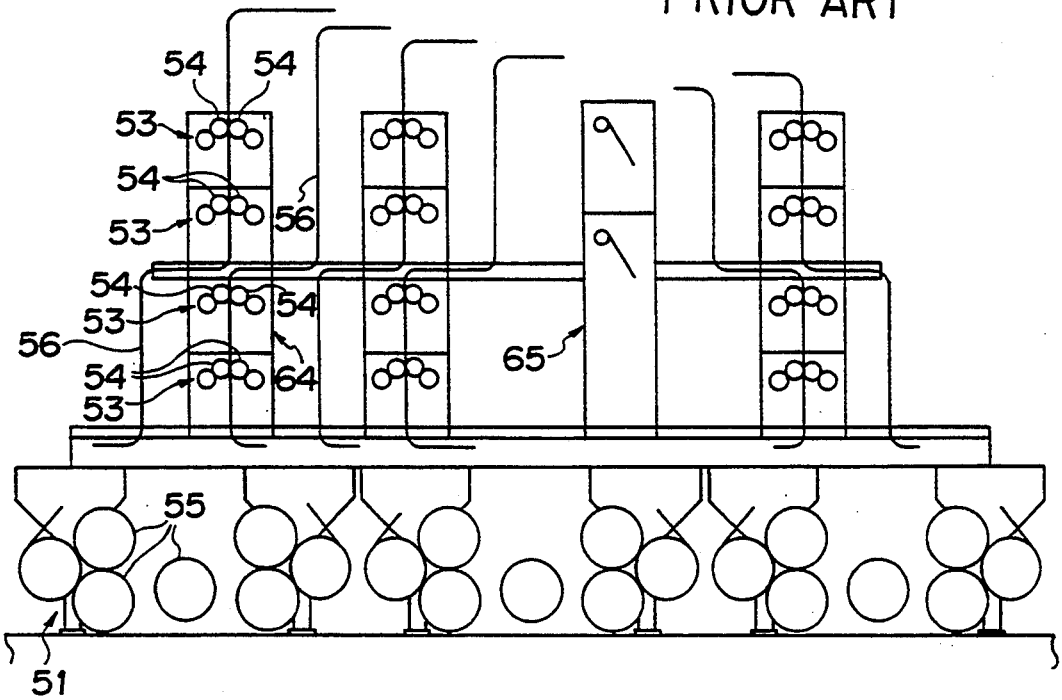
FIG. 8 PRIOR ART
FIG. 8 is a schematic front elevation of a prior art rotary press with tower type printing unit.

Since the feeder units 1 are provided at right angles to the tower type printing units 2, a regular paper web handling operation including an operation for supplying paper rolls 5 to the feeder units 1 can be carried out from one side of a feeder unit 1 shown in FIG. 2; i.e., unlike the prior art rotary press shown in FIG. 8, the rotary press according to the present invention does not need to have this operation carried out in a space between feeder units.

Therefore, in the rotary press in the first embodiment, six paper webs 6 are supplied to three tower type printing units 2, each of which has two printing means, and each feeder unit 1 may be operated for one relative tower type printing unit 2, so that all feeder units 1 can be arranged in the space just under the arrangement of the tower type printing units 2. Accordingly, the inconvenience that the total length of the arrangement of the feeder units 51 in the prior art rotary press of FIG. 8 becomes much larger than that of the arrangement of the tower type printing units 64 is eliminated.

Figure 4:
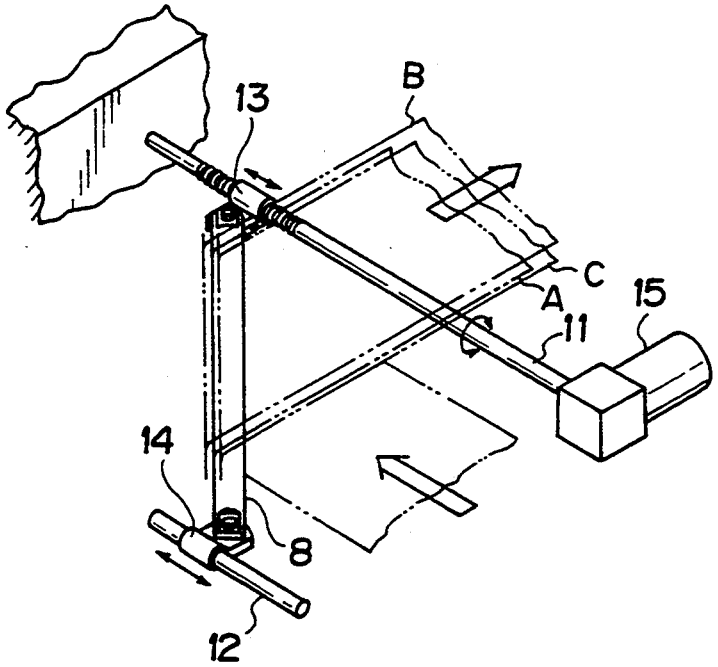
FIG. 4 is a schematic perspective view of a position regulating means consisting of a web turning means in the first embodiment of the rotary press according to the present invention.

In the structure of this embodiment, the position A of a paper web 6 to be guided in the widthwise direction of the printing means 3 can be changed by moving the web guide surface of the web turning means 7. Namely, as shown in, for example FIG. 4, a turning bar 8 is provided between a lead screw 11 and a guide bar 12, which extend in parallel with the lead screw 11, via a female screw bracket 13 and a slide bracket 14. The lead screw 11 is turned by a driving means 15, and the turning bar 8 is moved in the axial direction of the lead screw 11, so that the position of the paper web 6 to be guided can be changed to B or C shown in the drawing.

Figure 9:
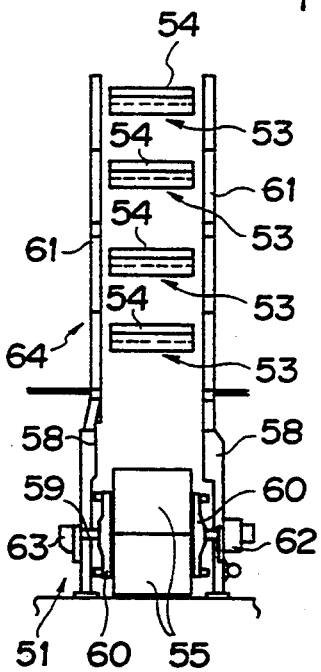
FIG. 9 PRIOR ART
FIG. 9 is a schematic side elevation of the rotary press of FIG. 8.

This enables the means in a prior art rotary press for changing the position of a paper web to be guided to be rendered unnecessary, i.e., a means 63 shown in FIG. 9, for moving a rotary shaft 59 in the axial direction thereof so as to move a paper roll 55, which is supported between arms 60, 60, in the axial direction thereof becomes unnecessary.

The path for each paper web 6 in the first embodiment described above, which extends toward the folder unit 10 via the tower type printing unit 2 is substantially identical with that in a second embodiment of FIG. 6 to be described later. Since this path does not have direct relation with the present invention, an illustration thereof is omitted in FIG. 1.

Figure 5:
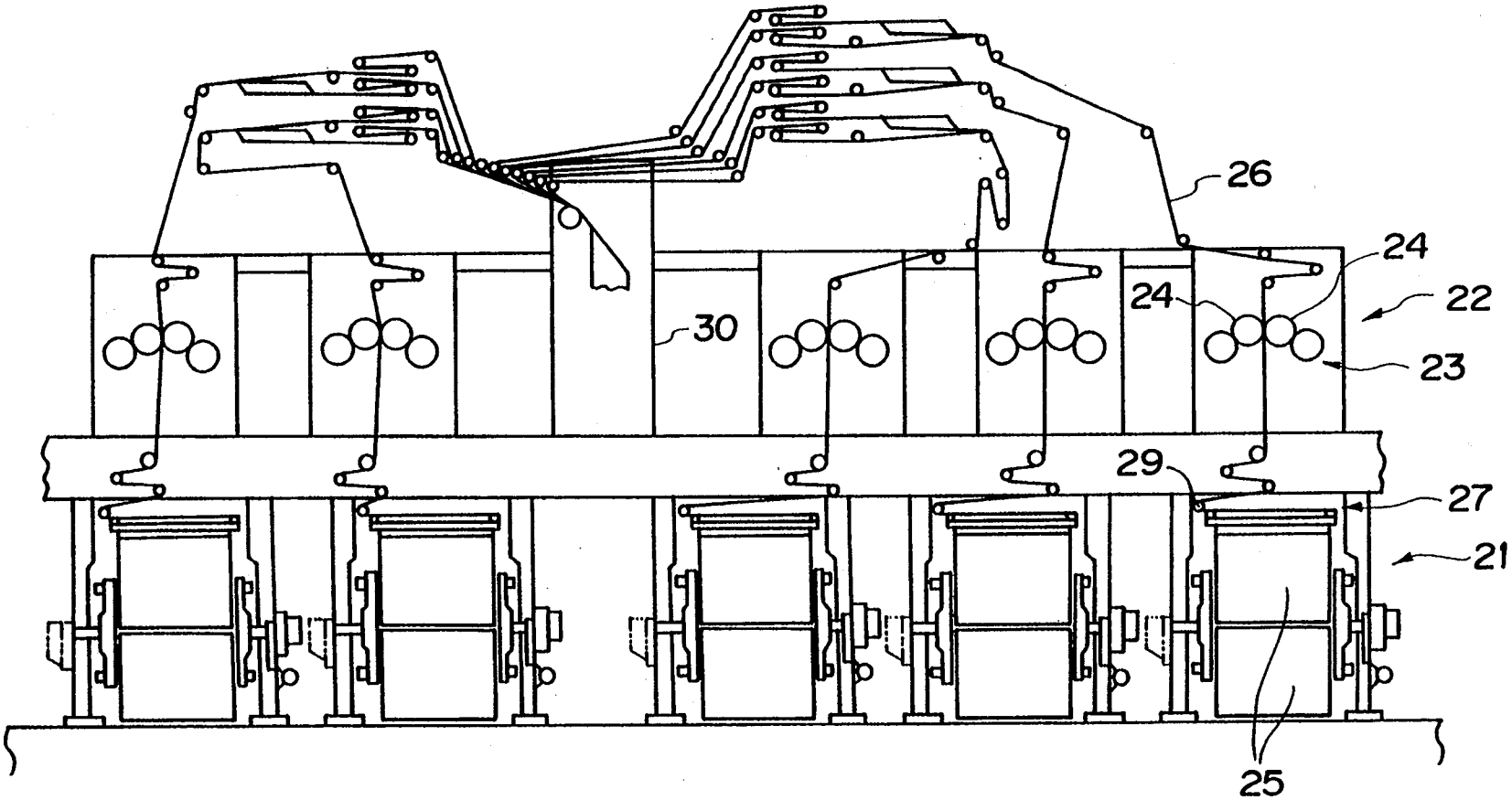
FIG. 5 is a schematic front elevation of a second embodiment of the rotary press according to the present invention.
Figure 6:
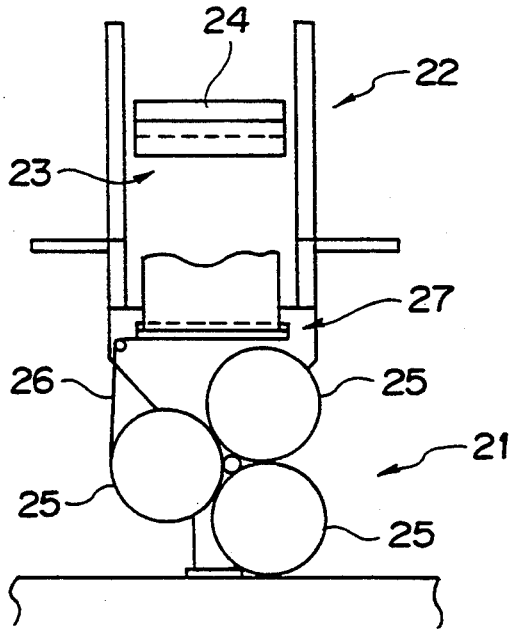
FIG. 6 is a schematic side elevation of the second embodiment of the rotary press according to the present invention.

In the rotary press in a second embodiment shown in FIGS. 5 and 6, five feeder units 21 and five regular printing units 22 are vertically arranged so that the feeder units 21 become at right angles to the printing units 22, i.e., the axes of paper rolls 25 set on the feeder units 21 become at right angles to those of printing cylinders 24 in the printing means 23 in the printing units 22. In a threading path for paper web along which a paper web 26 drawn out from a paper roll 25 advances up to a printing means 23 in a printing unit 22, a web turning means 27 for turning the surface of the paper web 26 so as to be opposed to the circumferential surfaces of printing cylinders 24 in the printing means 23 is provided.

According to this structure, the direction of advance of the paper web 26 drawn out from the paper roll 25 supported on the feeder unit 21 is changed by the web turning means 27, and the paper web 26 is thus guided toward the printing unit 22.

Figure 7:
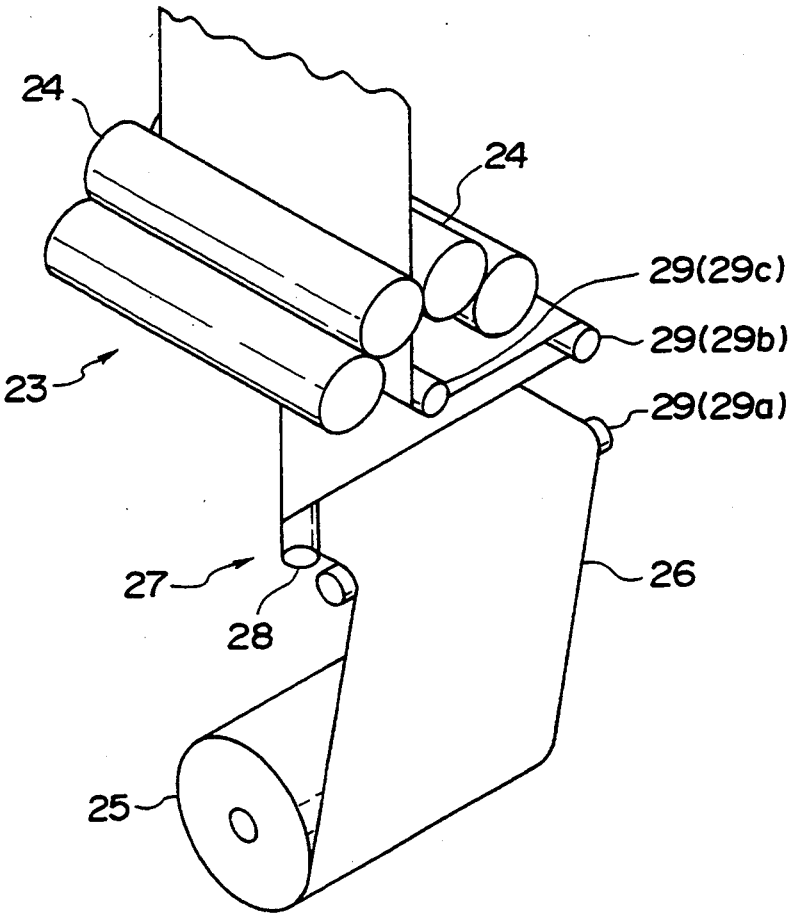
FIG. 7 is a schematic perspective view showing the condition of a paper web passed from a feeder unit on which paper rolls are supported to a printing means in the second embodiment of the rotary press according to the present invention.

The web turning means 27 consists of a turning bar 28 as shown in, for example, FIG. 7, and is adapted to guide a paper web 26 to the printing means 23 by the auxiliary actions of some guide rollers 29. In the example of FIG. 7, the paper web 26 drawn out from the paper roll 25 is guided to the printing means 23 via a guide roller **29*a*, the turning bar 28, a guide roller 29*b* and a guide roller 29*c***.

Referring to FIG. 5, the paper web 26 which has passed the printing means 23, and which has been printed thereby, is guided to a folder unit 30 and folded.

Figure 10:
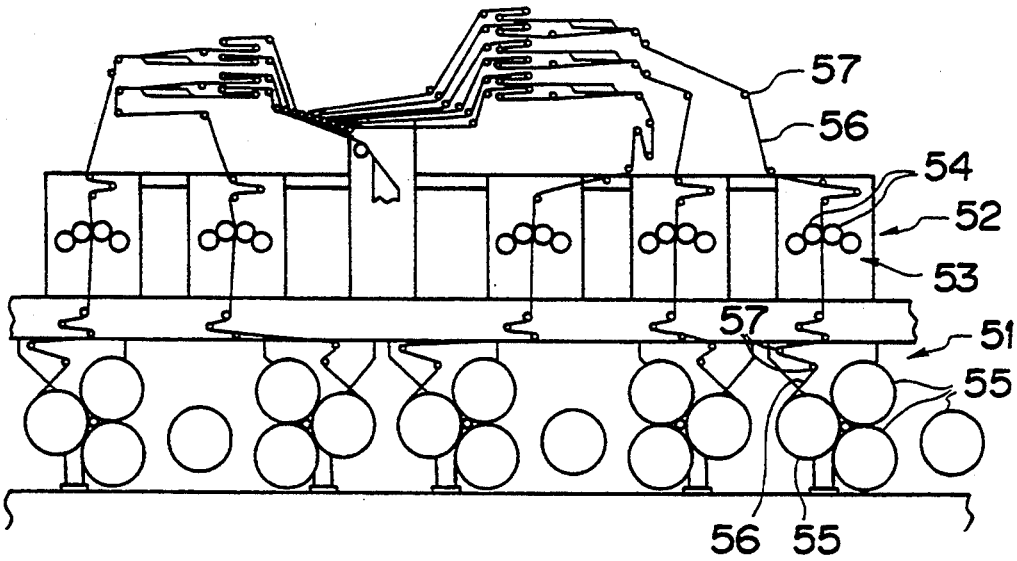
FIG. 10 PRIOR ART
FIG. 10 is a schematic front elevation of a prior art rotary press with regular printing unit.
Figure 11:
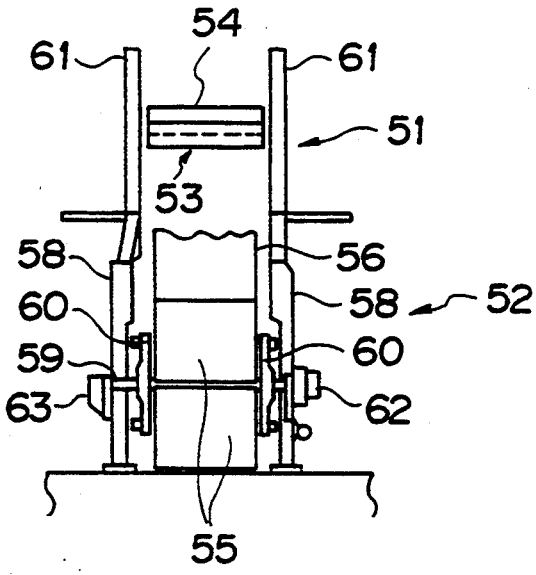
FIG. 11 PRIOR ART
FIG. 11 is a schematic side elevation of the rotary press of FIG. 10.

Since the feeder units 21 are provided at right angles to the printing units 22, a regular paper web handling operation including an operation for supplying paper rolls 25 to the feeder units 21 can be carried out from one side of the feeder unit shown in FIG. 6, and therefore, unlike the prior art rotary press shown in FIG. 10, the rotary press in the second embodiment does not need to have this operation carried out in a space between feeder units.

Therefore, in the second embodiment, five feeder units 21 for supplying paper webs 26 to five printing units 22 can be arranged within the space just under the printing units 22. Accordingly, the inconvenience with the prior art rotary press of FIG. 10 that the total length of the arrangement of the feeder units 51 becomes larger than that of the arrangement of the printing units is eliminated.

In addition, in the structure of this embodiment, the position of the paper web 26 to be guided, with respect to the widthwise direction of the printing means 23 can also be changed by a movement of the guide surface of the web turning means 27, in completely the same manner as in the first embodiment (refer to FIG. 3).

In the case (not shown) where the same feeder units as used in the first embodiment (refer to FIGS. 1 and 2), i.e. the feeder units capable of supporting a plurality of paper rolls thereon respectively and feeding paper webs from a plurality of paper rolls out of these paper rolls are provided in a rotary press having the same printing units as shown in FIG. 5, for example, only one feeder unit per two printing units is required, so that the number of the feeder units can be reduced. Accordingly, the feeder units in this case can be arranged more freely than those shown in FIG. 5.

The present invention is not limited to the above-described embodiments, and it includes modifications not departing the scope of the claims thereof. For example, the angle of installation of the feeder units with respect to that of the printing units may be set to a suitable level (for example, 45°).

With regard to the rotary press and feeder unit according to the present invention, the feeder units are provided in a non-parallel relation with respect to the printing units, so that a regular paper web handling operation including an operation for supplying paper rolls to the feeder units can be carried out from one side of the feeder units, i.e., it is not necessary to carry out this operation in a space between feeder units. Therefore, the installation intervals of the feeders can be reduced, so that the total length of the arrangement of the feeder units decreases. This enables all of the feeder units to be arranged within the space just below the arrangement of the printing units, and the space for installing the equipment to be thereby saved.

In a structure having a plurality of paper rolls on each of the feeder units provided in a non-parallel relation with respect to printing units, and capable of feeding paper webs from at least two paper rolls out of these paper rolls, the number of the feeder units in the rotary press is smaller than that of the printing units therein. Consequently, the feeder units can be arranged more freely, and the space for installing equipment therein could be saved.

Therefore, in order to print images on a plurality of paper webs by threading the same through a tower type printing unit, a feeder unit capable of feeding paper webs from at least two paper rolls is provided for each tower type printing unit in a rotary press with tower type printing unit. This enables the sizes in plan of the arrangement of the feeder units to be kept not larger than those of the arrangement of the relative tower type printing units.

The problem that the surfaces of the paper webs drawn out from paper rolls are not opposed to the printing means due to the non-parallel arrangement of the feeder unit and the relative printing unit is solved by the provision of the web turning means having a guide surface inclined with respect to the direction in which a paper web is to be guided. Moreover, since the guide surface of the web turning means can be displaced in parallel with the longitudinal direction of a paper web, a travelling position of the paper web leaving the guide surface passes is shifted in the widthwise direction thereof. Thus, a position of a paper web with respect to the widthwise direction of the printing means can be changed by such a simply constructed means. Accordingly, the web position regulating device can be miniaturized and simplified, and a driving force can be reduced.

While the present invention has been described above with respect to typical preferred embodiments thereof, it should of course be understood that it should not be limited only to them but various changes or modifications may be made without departure from the scope of the invention defined by the appended claims.

I claim:

1. A rotary press, comprising:

a feeder unit provided with a paper roll support frame, said paper roll support frame including means for supporting at least two paper rolls with each of the paper rolls having a central axis in a generally horizontal position and in a generally parallel side-by-side relation to one another in said feeder unit such that the outside cylindrical surfaces of the paper rolls are side-by-side and facing each other;

a printing unit provided with a printing means, said printing means including at least two printing cylinders, each having a central axis supported in a generally horizontal position;

means for simultaneously feeding at least two of said at least two paper rolls to said printing unit;

said central axes of said paper rolls in said feeder unit being disposed in a non-parallel and vertical relation with respect to said central axis of each said at least one printing cylinder in said printing unit so that said feeder unit can support a plurality of paper rolls thereon and pay out paper webs at once from at least two paper rolls out of said paper rolls;

web turning means for changing the directions of advance of the paper webs, which are fed from said paper rolls supported on said feeder unit, and sent to said printing means, in such a manner that the surfaces of said paper webs are opposed to at least one of said at least two cylinders of said printing means, wherein said web turning means has a first member which turns a first web from a first of the paper rolls at a first location and a second member which turns a second web from a second of the paper rolls at a second location above said first location such that said second web extends at least partially over said first web and creates a compact structure.

2. A rotary press according to claim 1, wherein said web turning means is provided so that a guide surface thereof can be displaced in the direction in which the position of said paper web with respect to the widthwise direction of said printing means is changed.

3. The rotary press according to claim 2, wherein said feeder unit is provided with a plurality of paper roll support frames, each said support frames supporting at least two paper rolls and including means for paying out paper webs at once from at least two paper rolls out of the paper rolls set on each of said paper roll support frames.

4. The rotary press according to claim 1, wherein said non-parallel relation comprises said central axis of said paper roll and said central axis of said printing cylinder being at least at an angle of 45 degrees from one another.

5. The rotary press according to claim 1, wherein said non-parallel relation comprises said central axes of said paper rolls and said central axis of said at least one printing cylinder being substantially at an angel of 90 degrees from one another.

6. A rotary press, comprising:

a feeder unit provided with a paper roll support frame, said paper roll support frame including means for supporting at least two paper rolls with each of the paper rolls having a central axis in a generally horizontal position and in a generally parallel side-by-side relation to one another in said feeder unit such that the outside cylindrical surfaces of the paper rolls are side-by-side and facing each other;

a tower type printing unit provided with a plurality of stacked printing means, each of said printing means including at least one printing cylinder each having a central axis supported in a generally horizontal position;

means for simultaneously feeding at least two of said at least two paper rolls to said tower type printing unit;

said central axes of said paper rolls in said feeder unit being disposed in a non-parallel and vertical relation with respect to said central axes of each said at least one printing cylinder in said printing unit so that said feeder unit can support a plurality of paper rolls thereon and pay out paper webs at once from at least two paper rolls out of said paper rolls;

said rotary press being further provided with web turning means for changing the directions of advance of the paper webs, which are fed from said paper rolls supported on said feeder unit, and sent to said printing means, in such a manner that the surface of said paper webs are opposed to at least one of said at least one cylinders of said printing means, wherein said web turning means has a first member which turns a first web from a first of the paper rolls at a first location and a second member which turns second web from a second of the paper rolls at a second location above said first location such that said second web extends at least partially over said first web and creates a compact structure.

7. A rotary press according to claim 6, wherein said web turning means is provided so that a guide surface thereof can be displaced in the direction in which the position of said paper web with respect to the widthwise direction of said printing means is changed.

8. The rotary press according to claim 6, wherein said non-parallel relation comprises said axes of each said at least two paper rolls being at an angle of at least 45 degrees from said widthwise direction of said printing means.

9. The rotary press according to claim 6, wherein said non-parallel relation comprises said central axes of said paper rolls and said central axis of said at least one printing cylinder being substantially at an angle of 90 degrees from one another.

* * * * *